United States Patent [19]

Meyer et al.

[11] Patent Number: 4,888,030

[45] Date of Patent: Dec. 19, 1989

[54] CREOSOTE REMOVAL COMPOSITION

[76] Inventors: William R. Meyer, RR #1 Box 7C, Sabula, Iowa 52070; Calvin F. Dechow, RR #1, Box 112, Cassville, Wis. 53806

[21] Appl. No.: 219,380

[22] Filed: Jul. 14, 1988

[51] Int. Cl.[4] ..... C10L 10/00

[52] U.S. Cl. ..... 44/640

[58] Field of Search ..... 502/407, 411; 44/640, 44/641, 603, 506

[56] References Cited

U.S. PATENT DOCUMENTS

| | | | |
|---|---|---|---|
| 846,338 | 5/1907 | McNamara | 44/603 |
| 1,592,989 | 7/1926 | Nolan | 44/640 |
| 2,139,398 | 12/1938 | Allen | 44/602 |
| 3,249,075 | 5/1966 | Nelson et al. | 44/640 |
| 4,526,703 | 7/1985 | Gebhard et al. | 44/641 |

FOREIGN PATENT DOCUMENTS

| | | | |
|---|---|---|---|
| 168799 | 9/1921 | United Kingdom | 44/640 |

*Primary Examiner*—Carl F. Dees

[57] ABSTRACT

A creosote removal compound comprising hydrated aluminum silicate in an amount totaling between forty and eighty percent of the total overall mixture, calcium hydroxide in an amount totaling between fifteen and fifty percent of the total overall mixture and sodium bicarbonate in an amount totaling between five and twenty-five percent of the total overall mixture. The compound is formed having a mesh size of about three hundered and fifty so as to enable the same to be applied using a conventional dusting device. In other embodiments, the amount of the sodium bicarbonate may be substituted therefore with potassium bicarbonate. In another embodiment, the calcium hydroxide may be reduced by as much as twenty-five percent of the total mixture and substituted therefore with magnesium hydroxide. The compound lends itself to direct dry application to the creosote.

4 Claims, No Drawings

CREOSOTE REMOVAL COMPOSITION

BACKGROUND OF THE INVENTION

This patent relates to the use of a novel compound for reducing the buildup of creosote from the flues of combustion areas. The compound is comprised of hydrated aluminum silicate, calcium hydroxide and sodium bicarbonate.

Wood has been a primary source of residential heat throughout the history of the United States. Declines in solid fuel usage were noted with the advent of oil and gas furnaces. Additional declines were also noted with advances in residential heating, which included both passive and active solar heating, as well as heat pumps and geothermal heating, to name a few. Each advance in technology brought reductions in solid fuel heating until the realization that oil was not a renewable energy source and the oil embargo in the early seventies. As a result of these developments, the trend has been an increase in the use of residential heating.

Recent literature indicates that 59 percent of all new homes built in 1988 will include at least one fireplace—up from 54 percent the previous year. More than twelve million homes burned wood for the primary source of heat in 1986. In this same year, there were 113,000 reported residential fires as a result of burning wood. Based on 1983 data, this accounted for more than 26 percent of all residential fires. Based on a normal six-month heating season, it would be expected that one residential fire occurred every 1.9 minutes as a result of heating with wood. The total dollar loss due to these fires, in 1983, amounted to 745 million dollars, or about 4 million dollars per day during the heating season. Based on a national average of deaths resulting from residential fires, it would be expected that 789 deaths were related to heating with wood, or approximately one death every 4.32 hours, as well as one injury every 60 minutes.

The primary reason for residential fires, based on the C.R., dated September, 1985, is due to chimney fires. Fires result when there is an excess buildup of creosote within the chimney. According to this article, flammable creosote is deposited in the chimney while burning the wood, particularly the older airtight stoves that have been used for burning small, slow fires. When the temperature in the flue reaches 1500 degrees F., during start-up or reloading of some wood stoves, the creosote can ignite. If ignition takes place, sparks and/or flames can ignite the roof. As well, the flames can penetrate the walls of the chimney, igniting beams, rafters or other combustible materials, resulting in severe structural damage, personal injury or death.

One method for reducing the risk of fire, is the periodic cleaning of the chimney with wire brushes, chains, or rough fabric material by passing them down the chimney from the roof with a rope, cable, or rigid member. Any of the above-mentioned implements will break lose the flammable residue which, then, falls down the chimney flue to the clean-out area, at which point, it is removed by hand and discarded. This method is time consuming, messy and often requires the assistance of at least one other person to effectively complete the operation.

The second method for reducing flammable creosote is the addition of any of a number of commercially available chimney cleaning agents, which are placed directly into the fire, vaporized, and recondensed on the flue lining forming a thin chemical coating on the chimney wall, which helps reduce the formation of the creosote. These chemicals are seldom effective in fully preventing creosote buildup. Furthermore, this method does not solve the problem of eliminating existing creosote.

Another type of cleaning agent which is used quite widely has a low fire point, which ignites the creosote before excessive buildup occurs. Again, this method is not fully effective, and requires its use in the presence of a fire, which would continue to generate creosote. And, as with the second method, existing creosote would not be eliminated.

Compounds have been developed which can be effective in removing deposits of creosote. These generally contain chloride salts, such as sodium chloride. It is known that the effectiveness is increased in the presence of additional metallic chlorides. Unfortunately, these salts are extremely corrosive to metal, and would therefore, not be suited for the "air tight" variety of metal stoves which are in wide use today. One company has address the corrosive problem of chloride salts on metal flues. The patent to Mackowiak et al, U.S. Pat. No. 4,481,010, which is assigned to Hercules Chemical Company, Inc., attempts to overcome the corrosion problem by the addition of a corrosion inhibitor, i.e. trisodium phosphate dodecylhydrate. While the patent claims a non-corrosive product, the specifications state that the corrosive effects are "substantially reduced", as opposed to being eliminated. Furthermore, the product requires the use of a fire in its method of application.

Accordingly, there is a need for means for removing existing creosote deposits which can be applied by a single individual, and which can be applied in the absence of any fire, and which would be non-corrosive to metal.

SUMMARY OF THE INVENTION

This invention provides a compound for removing creosote which comprises between 40 to 80 percent by weight hydrated aluminum silicate, 15 to 50 percent by weight calcium hydroxide and 5 to 25 percent by weight sodium bicarbonate. It has been discovered that the combination of the aluminum silicate with the calcium hydroxide.

In view of the limitations of the known methods and compounds for removing creosote from combustion flues, it is a primary object of this invention to provide a creosote removal compound comprised of hydrated aluminum silicate, calcium hydroxide and sodium bicarbonate.

It is a further object of this invention is provide a creosote removal compound which is non-corrosive to metal.

It is another object of this invention to provide a creosote removal compound which can be applied in the absence of fire.

It is another object of this invention to provide a creosote removal compound which is effective in the removal of existing creosote deposits.

The creosote removal compound in the preferred form of the invention is comprised of hydrated aluminum silicate in an amount totaling between forty and eighty percent of the overall mixture, calcium hydrate in an amount totaling between one and forty percent of the overall mixture and sodium and sodium bicarbonate amounting to between one and twenty-five percent of the overall mixture.

In another form of the invention, the calcium hydroxide may be may be reduced by as much as ten percent and substituted therefor with magnesium oxide according to the reduced amount.

In yet another form of the invention, the sodium bicarbonate may be substituted with potassium bicarbonate.

It is preferred that the mesh size be approximately three hundred-fifty.

The compound is formed by thoroughly mixing hydrated aluminum silicate in an amount of approximately sixty percent with calcium hydroxide in an amount totaling about thirty percent of the overall mixture and sodium bicarbonate totaling about ten percent. If formed having a mesh size of about three hundred-fifty, the same may easily be adapted for direct application through means of an applicator, such as one would expect to use for dusting flowers. The applicator means forms no part of this invention.

The ability for the mixture to be applied using knowing dusting means enables the same to be directly applied to the surface of the creosote. In conventional methods, creosote removal compounds were applied in a fire and relied on the heat to carry the compound up the flue an onto the creosote. This method, as pointed out above, will necessarily carry together with it, a certain amount of fresh creosote. The mixture of the subject invention, may be applied to the surface of the flue walls regardless of whether there is currently a fire burning.

The mixture is applied to the surface of the flue and permitted to react with the creosote for a period of about twenty-four hours. At this time, the flue may be scraped with tools readily available in the art to flake the loosened creosote from the walls. Alternatively, a fire may be started to generate an upward draft which will then free creosote.

In some applications, it may be necessary to treat the flue a second, or even a third time. Unlike with many of the known compounds, the compound of the subject invention contains no salts which would corrode the metal surfaces of the flue. As many applications may be made until the creosote is fully removed.

Other means for applying the compound would include pouring the same down the flue or chimney from above. The compound will adhere to the walls and begin reacting with the creosote. Alternatively the creosote may be carried up the flue using the updraft of a fire. While this is only a possible means of application, it is not to be considered at all necessary. This method may be preferred during the winter months of some portions of the country when fireplaces are burning almost constantly and when the buildup of creosote is most rapid.

It is believed that the compound of the subject invention dehydrates the creosote enabling it to simply flake apart. This was demonstrated during a controlled experiment where a measured amount of creosote was allowed to build up on a piece of test sample. The compound was then applied and the results recorded. It was found that, within a twenty-four hour period, more than forty percent of the creosote flaked away from the test sample. It was discovered, however, that most of the dehydrating—more than fifty percent thereof—occurred during the first few hours of the experiment.

The dehydrating process occurs, it is further believed, as the compound attaches itself to the active cites of the benzene ring, of which, the creosote is comprised. These active cites bond adjacent benzene rings to each other. When the compound attaches itself to these sites, the bond is broken and the creosote is free to flake apart.

It has been discovered that several substitutions may be made for some of the components of the preferred embodiment. For example, it has been discovered that magnesium oxide may be substituted for a portion of the calcium hydroxide, up to, but not exceeding more than on forth thereof. As an illustration, the preferred mixture suggests the addition of about thirty percent calcium hydroxide. This may be reduced by between one and ten percent and substituted by a corresponding amount of magnesium oxide.

It has been further discovered that the sodium bicarbonate can just as well be substituted with potassium bicarbonate as long as the same is included at a percent of the overall mixture between one and twenty-five percent.

I claim:

1. A creosote removal composition comprising:
   hydrated aluminum silicate amounting to between forty and eighty percent of the total mixture;
   calcium hydroxide amounting to between one and forty percent of the overall mixture, and
   sodium bicarbonate amounting to between one and twenty-five percent of the overall mixture.

2. A creosote removal composition according to claim 1 whereby, the amount of the said calcium hydroxide may be reduced and substituted therefore with a corresponding amount of magnesium hydroxide whereby the reduction of the said calcium hydroxide is not to exceed fifty percent of the overall mixture.

3. A creosote removal composition according to claim 1 whereby,
   the said sodium bicarbonate is substituted therefor with potassium bicarbonate amounting to between one and twenty-five percent of the overall mixture.

4. A creosote removal composition according to claim 1 whereby the mesh size of the mixture is approximately two hundred fifty.

* * * * *